US006230645B1

(12) United States Patent
Chow

(10) Patent No.: US 6,230,645 B1
(45) Date of Patent: May 15, 2001

(54) FLOATING OFFSHORE STRUCTURE CONTAINING APERTURES

(75) Inventor: Fred I. Chow, Houston, TX (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/417,689

(22) Filed: Oct. 13, 1999

Related U.S. Application Data

(63) Continuation-in-part of application No. 09/146,790, filed on Sep. 3, 1998, now Pat. No. 5,983,822.

(51) Int. Cl.[7] ..... B63B 35/44
(52) U.S. Cl. ..... 114/264; 114/125
(58) Field of Search ..... 114/121, 122, 114/125, 264, 265, 266, 124

(56) References Cited

U.S. PATENT DOCUMENTS

| | | | |
|---|---|---|---|
| 2,889,795 | 6/1959 | Parks . | |
| 3,313,694 | 4/1967 | Ayers, Jr. | 167/65 |
| 3,360,810 | 1/1968 | Busking . | |
| 3,572,041 | 3/1971 | Graaf | 61/46.5 |
| 3,572,278 | 3/1971 | Knapp et al. . | |

(List continued on next page.)

FOREIGN PATENT DOCUMENTS

| | | | |
|---|---|---|---|
| 020 029 B1 | 11/1986 | (EP) | B63B/35/44 |
| 0 207 915 B1 | 7/1987 | (EP) | B63B/35/44 |
| 0 236 722 A1 | 9/1987 | (EP) | E02B/17/00 |
| 0 256 177 A1 | 2/1988 | (EP) | B63B/35/44 |
| 2 559 808 | 8/1985 | (FR) | E02B/17/00 |
| 2 568 908 | 2/1986 | (FR) | E02B/17/00 |
| 2 574 367 | 6/1986 | (FR) | B63B/35/44 |

(List continued on next page.)

OTHER PUBLICATIONS

"Deepwater Production," Offshore, Jan., 1984, pp. 58–60.
"Modern Production Risers," Part 11—The Buoyant Tower—New Deepwater Drilling and Production Concept by Ross Cowan and Edward E. Horton, Petroleum Engineering International, Feb. 1983, pp. 36–56.
"Search Second Phase," Offshore Engineering, Aug., 1985, pp. 43 & _.
"The Gamma Tower—A New Concept for Deep Water"; W. L. Hudson and L. Des Deserts, C. G. Doris, T. A. Holy, Fluor–Doris, Inc., pp 75–90.
"The Q. U. B. Axisymmetric and Multi–Resonant Wave Energy Convertors," T. J. T. Whittaker, J. G. Leitch, A. E. Long, and M. A. Murray, _Energy Resources Technology, Mar. 1985, vol. 107, pp. 74–80.

(List continued on next page.)

*Primary Examiner*—Stephen Avila
(74) *Attorney, Agent, or Firm*—Morris N. Reinisch; Howrey Simon Arnold & White

(57) ABSTRACT

A floating offshore structure for use in oil or gas drilling or production operations, having apertures in its sides in order to reduce the movement of the structure as a result of undersea currents is disclosed herein. The structure contains a production platform extending above the ocean's surface, a series of buoyancy tanks providing the structure with the ability to float, apertures, surrounded by coamings, located around the structure such that ocean currents are allowed to flow laterally through the center of the structure and such that oil and gas can dissipate from the center of the structure if a rupture occurs, a fluid retention tank and ballast in order to lower the center of gravity of the structure and make it more stable, and a centerwell running through the longitudinal center of the structure which allows one or more risers to run from the ocean floor to the operating platform. The structure can then be moored to the sea floor through the use of a catenary or other mooring system.

13 Claims, 4 Drawing Sheets

U.S. PATENT DOCUMENTS

| | | | |
|---|---|---|---|
| 3,824,943 | 7/1974 | Mo | 114/0.5 |
| 3,854,297 | 12/1974 | Broussard et al. | 61/72.3 |
| 3,921,557 | 11/1975 | Kapteijn et al. | 114/0.5 T |
| 3,921,558 | 11/1975 | Redshaw | 114/0.5 T |
| 3,979,785 | 9/1976 | Flory | 9/8 P |
| 3,981,357 | 9/1976 | Walker et al. | 166/0.5 |
| 3,994,140 | 11/1976 | Gunderson | 61/108 |
| 4,019,334 | 4/1977 | Sinclair et al. | 61/110 |
| 4,075,862 | 2/1978 | Ames | 61/110 |
| 4,078,584 | 3/1978 | Behar et al. | 138/107 |
| 4,105,068 | 8/1978 | Tam | 166/355 |
| 4,118,941 | 10/1978 | Bruce et al. | 405/204 |
| 4,126,183 | 11/1978 | Walker | 166/338 |
| 4,145,909 | 3/1979 | Daughtry | 405/168 |
| 4,147,221 | 4/1979 | Ilfrey et al. | 175/7 |
| 4,185,541 | 1/1980 | Milberger et al. | 91/526 |
| 4,191,256 | 3/1980 | Croy et al. | 166/343 |
| 4,201,074 | 5/1980 | Cox | 72/168 |
| 4,210,208 | 7/1980 | Shanks | 166/352 |
| 4,211,281 | 7/1980 | Lawson | 166/345 |
| 4,213,476 | 7/1980 | Bresie et al. | 137/2 |
| 4,223,920 | 9/1980 | Van Bilderbeek | 285/24 |
| 4,225,160 | 9/1980 | Ortloff | 282/137 A |
| 4,231,313 | 11/1980 | Heerema et al. | 114/125 |
| 4,249,610 | 2/1981 | Loland | 166/360 |
| 4,260,291 | 4/1981 | Young et al. | 405/205 |
| 4,261,671 | 4/1981 | Langner | 405/166 |
| 4,271,867 | 6/1981 | Milberger et al. | 137/625.21 |
| 4,273,066 | 6/1981 | Anderson | 114/256 |
| 4,280,531 | 7/1981 | Milberger et al. | 137/624.11 |
| 4,289,336 | 9/1981 | Bajeux | 285/136 |
| 4,298,064 | 11/1981 | Lawson | 166/75 A |
| 4,299,260 | 11/1981 | Jensen | 141/311 R |
| 4,299,261 | 11/1981 | Talafuse | 141/387 |
| 4,310,263 | 1/1982 | Daughtry | 405/169 |
| 4,311,327 | 1/1982 | Ortloff et al. | 285/136 |
| 4,329,085 | 5/1982 | Morrill et al. | 405/169 |
| 4,337,970 | 7/1982 | Gunderson | 285/136 |
| 4,347,900 | 9/1982 | Barrington | 166/380 |
| 4,360,290 | 11/1982 | Ward | 405/170 |
| 4,362,413 | 12/1982 | Heard et al. | 403/14 |
| 4,371,005 | 2/1983 | Morrill et al. | 138/89 |
| 4,371,291 | 2/1983 | Morrill et al. | 405/169 |
| 4,375,239 | 3/1983 | Barrington et al. | 166/336 |
| 4,382,717 | 5/1983 | Morrill | 405/169 |
| 4,389,461 | 6/1983 | Scott | 428/543 |
| 4,390,043 | 6/1983 | Ward | 138/89 |
| 4,391,332 | 7/1983 | Fayren | 166/350 |
| 4,407,183 | 10/1983 | Milberger et al. | 91/1 |
| 4,426,173 | 1/1984 | Richart et al. | 405/195 |
| 4,427,072 | 1/1984 | Lawson | 166/345 |
| 4,432,420 | 2/1984 | Gregory et al. | 166/355 |
| 4,436,450 | 3/1984 | Reed | 405/171 |
| 4,452,312 | 6/1984 | Roblin | 166/339 |
| 4,456,073 | 6/1984 | Barth et al. | 166/367 |
| 4,470,722 | 9/1984 | Gregory | 405/195 |
| 4,472,079 | 9/1984 | Langner | 405/167 |
| 4,473,323 | 9/1984 | Gregory | 405/224 |
| 4,476,897 | 10/1984 | Morrill | 137/594 |
| 4,477,205 | 10/1984 | Morrill et al. | 405/169 |
| 4,478,287 | 10/1984 | Hynes et al. | 166/341 |
| 4,490,073 | 12/1984 | Lawson | 405/169 |
| 4,492,270 | 1/1985 | Horton | 166/358 |
| 4,493,282 | 1/1985 | Ortloff | 114/230 |
| 4,493,589 | 1/1985 | Ward | 405/166 |
| 4,493,590 | 1/1985 | Ayers et al. | 405/170 |
| 4,500,117 | 2/1985 | Ayers et al. | 285/3 |
| 4,502,551 | 3/1985 | Rule et al. | 175/6 |
| 4,511,288 | 4/1985 | Wetmore | 405/217 |
| 4,512,408 | 4/1985 | Danielson et al. | 166/349 |
| 4,523,877 | 6/1985 | Finn et al. | 405/195 |
| 4,526,206 | 7/1985 | Ayers | 138/89 |
| 4,527,633 | 7/1985 | Mclaughlin et al. | 166/370 |
| 4,529,334 | 7/1985 | Ortloff | 405/195 |
| 4,532,879 | 8/1985 | Ortloff | 114/230 |
| 4,534,678 | 8/1985 | Nakazato et al. | 405/204 |
| 4,541,753 | 9/1985 | Langner | 405/166 |
| 4,546,830 | 10/1985 | McLaughlin et al. | 166/370 |
| 4,547,163 | 10/1985 | Langpaap et al. | 441/2 |
| 4,549,578 | 10/1985 | Hibbs et al. | 137/624.11 |
| 4,553,879 | 11/1985 | Langner | 405/270 |
| 4,556,340 | 12/1985 | Morton | 405/195 |
| 4,558,972 | 12/1985 | Langner | 405/169 |
| 4,563,108 | 1/1986 | Ayers | 405/171 |
| 4,566,824 | 1/1986 | Minier et al. | 405/202 |
| 4,575,282 | 3/1986 | Pardue, Sr. et al. | 405/228 |
| 4,579,372 | 4/1986 | Morrill | 285/18 |
| 4,588,326 | 5/1986 | Langner | 405/169 |
| 4,591,292 | 5/1986 | Stevens et al. | 405/169 |
| 4,591,295 | 5/1986 | Collipp | 405/195 |
| 4,602,586 | 7/1986 | Ortloff | 114/230 |
| 4,606,673 | 8/1986 | Daniell | 405/210 |
| 4,612,994 | 9/1986 | Castel et al. | 166/344 |
| 4,615,645 | 10/1986 | Langner | 405/159 |
| 4,615,646 | 10/1986 | Langner | 405/169 |
| 4,620,818 | 11/1986 | Langner | 405/169 |
| 4,621,844 | 11/1986 | Kipp et al. | 285/381 |
| 4,625,801 | 12/1986 | McLaughlin et al. | 166/267 |
| 4,625,806 | 12/1986 | Silcox | 166/358 |
| 4,627,767 | 12/1986 | Field et al. | 405/196 |
| 4,629,365 | 12/1986 | Kuriiwa | 405/204 |
| 4,630,680 | 12/1986 | Elkins | 166/34.2 |
| 4,632,188 | 12/1986 | Schuh et al. | 166/368 |
| 4,637,470 | 1/1987 | Weathers et al. | 166/344 |
| 4,641,998 | 2/1987 | Baugh | 405/169 |
| 4,657,439 | 4/1987 | Petersen | 405/200 |
| 4,662,657 | 5/1987 | Harvey et al. | 285/96 |
| 4,662,785 | 5/1987 | Gibb et al. | 405/195 |
| 4,671,702 | 6/1987 | Langner | 405/169 |
| 4,674,576 | 6/1987 | Goris et al. | 166/382 |
| 4,678,040 | 7/1987 | McLaughlin et al. | 166/370 |
| 4,684,291 | 8/1987 | Hopper | 450/190 |
| 4,684,747 | 8/1987 | Sartorelli et al. | 564/81 |
| 4,685,409 | 8/1987 | Lidén | 114/74 R |
| 4,685,833 | 8/1987 | Iwamoto | 405/195 |
| 4,687,377 | 8/1987 | Langner | 405/169 |
| 4,695,193 | 9/1987 | Sebastiani et al. | 405/204 |
| 4,702,321 | 10/1987 | Horton | 166/350 |
| 4,704,050 | 11/1987 | Wallace | 405/195 |
| 4,735,267 | 4/1988 | Stevens | 166/345 |
| 4,740,110 | 4/1988 | Saffrhan | 405/225 |
| 4,753,552 | 6/1988 | Karal et al. | 405/189 |
| 4,784,523 | 11/1988 | Louis et al. | 405/169 |
| 4,789,269 | 12/1988 | Ayers et al. | 405/158 |
| 4,797,035 | 1/1989 | Hunter | 405/205 |
| 4,813,495 | 3/1989 | Leach | 175/6 |
| 4,819,730 | 4/1989 | Williford et al. | 166/355 |
| 4,828,430 | 5/1989 | van der Heyden | 405/209 |
| 4,850,743 | 7/1989 | Hopper | 405/190 |
| 4,864,958 | 9/1989 | Belinsky | 114/125 |
| 4,877,088 | 10/1989 | Rodrigues et al. | 166/342 |
| 4,877,356 | 10/1989 | Bontenbal | 405/169 |
| 4,895,481 | 1/1990 | Pepin-Lehalleur et al. | 405/224 |
| 4,911,243 | 3/1990 | Beynet | 166/340 |
| 4,913,238 | 4/1990 | Danazcko et al. | 166/350 |
| 4,960,174 | 10/1990 | Rodrigues et al. | 166/342 |
| 4,979,880 | 12/1990 | Delaittre | 417/406 |
| 4,982,681 | 1/1991 | Jarlan | 114/364 |
| 4,992,001 | 2/1991 | Harrison | 405/166 |
| 5,025,865 | 6/1991 | Caldwell et al. | 166/366 |
| 5,035,291 | 7/1991 | Shields | 175/5 |

| | | | |
|---|---|---|---|
| 5,040,607 | 8/1991 | Cordeiro et al. | 166/366 |
| 5,094,111 | 3/1992 | Collins et al. | 73/834 |
| 5,101,905 | 4/1992 | Arlt et al. | 166/350 |
| 5,117,914 | 6/1992 | Blandford | 166/344 |
| 5,129,459 | 7/1992 | Breese et al. | 166/339 |
| 5,154,741 | 10/1992 | da Costa Filho | 55/219 |
| 5,181,798 | 1/1993 | Gilchrist, Jr. | 405/170 |
| 5,186,581 | 2/1993 | Ngoe et al. | 405/217 |
| 5,188,180 | 2/1993 | Jennings | 166/338 |
| 5,188,483 | 2/1993 | Kopp et al. | 405/191 |
| 5,190,107 | 3/1993 | Langner et al. | 166/355 |
| 5,192,167 | 3/1993 | da Silva et al. | 405/195.1 |
| 5,199,821 | 4/1993 | Huete et al. | 405/202 |
| 5,207,534 | 5/1993 | Brasted et al. | 405/209 |
| 5,226,482 | 7/1993 | Giannesini et al. | 166/353 |
| 5,255,744 | 10/1993 | Silva | 166/347 |
| 5,273,376 | 12/1993 | Ritter, Jr. | 405/169 |
| 5,289,561 | 2/1994 | Costa Filho | 392/478 |
| 5,295,546 | 3/1994 | Giannesini et al. | 166/353 |
| 5,297,632 | 3/1994 | Blandford | 166/344 |
| 5,311,947 | 5/1994 | Kent et al. | 166/348 |
| 5,312,205 | 5/1994 | Wicks, III | 405/74 |
| 5,320,175 | 6/1994 | Ritter et al. | 166/339 |
| 5,330,293 | 7/1994 | White et al. | 405/211 |
| 5,341,884 | 8/1994 | Silva | 166/347 |
| 5,342,148 | 8/1994 | Huete et al. | 405/223.1 |
| 5,377,763 | 1/1995 | Pearce et al. | 166/367 |
| 5,379,844 | 1/1995 | Glasscock et al. | 166/358 |
| 5,381,865 | 1/1995 | Blandford | 166/344 |
| 5,410,979 | 5/1995 | Allen et al. | 114/243 |
| 5,421,675 | 6/1995 | Brown et al. | 405/170 |
| 5,431,512 | 7/1995 | Haney | 405/224 |
| 5,433,273 | 7/1995 | Blandford | 166/344 |
| 5,435,338 | 7/1995 | DaSilva et al. | 137/242 |
| 5,439,321 | 8/1995 | Hunter | 405/195.1 |
| 5,447,392 | 9/1995 | Marshall | 405/224.4 |
| 5,452,507 | 9/1995 | Brunner et al. | 29/428 |
| 5,458,440 | 10/1995 | Van Helvoirt | 405/169 |
| 5,458,441 | 10/1995 | Barry | 405/170 |
| 5,460,227 | 10/1995 | Sidrim | 166/357 |
| 5,464,307 | 11/1995 | Wilkins | 405/166 |
| 5,486,070 | 1/1996 | Huete | 504/202 |
| 5,490,562 | 2/1996 | Arnold | 166/267 |
| 5,501,549 | 3/1996 | Breda et al. | 405/169 |
| 5,505,502 | 4/1996 | Smith et al. | 285/334 |
| 5,547,314 | 8/1996 | Ames | 405/165 |
| 5,549,164 | 8/1996 | Blandford | 166/344 |
| 5,549,417 | 8/1996 | Ju et al. | 405/211 |
| 5,558,467 | 9/1996 | Horton | 405/195.1 |
| 5,609,442 | 3/1997 | Horton | 405/205 |
| 5,639,187 | 6/1997 | Mungall et al. | 405/195.1 |
| 5,657,823 | 8/1997 | Kogure et al. | 166/340 |
| 5,722,793 | 3/1998 | Peterson | 405/164 |
| 5,753,108 | 5/1998 | Haynes et al. | 210/122 |
| 5,983,822 * | 11/1999 | Chow et al. | 114/264 |

FOREIGN PATENT DOCUMENTS

| | | | |
|---|---|---|---|
| 2 603 923 | 3/1988 | (FR) | E02B/17/02 |
| 2 615 217 | 11/1988 | (FR) | E02B/17/00 |
| 2 645 827 | 10/1990 | (FR) | B63B/35/44 |
| 2 003 964 | 3/1979 | (GB) | E02B/17/00 |
| 2 156 283 | 10/1985 | (GB) | B63B/35/44 |
| 2 159 467 | 12/1985 | (GB) | B63B/25/08 |
| 2 292 349 | 2/1986 | (GB) | B63B/35/44 |
| 2 172 262 | 9/1986 | (GB) | B63B/35/44 |
| 2 243 118 | 10/1991 | (GB) | B63B/35/44 |
| WO 87/00138 | 1/1987 | (WO) | B63B/35/44 |
| WO 95/28315 | 10/1993 | (WO) | B63B/35/44 |
| WO 97/31817 | 9/1997 | (WO) | B63B/35/44 |

OTHER PUBLICATIONS

"Offshore Oil Loading and Storage Concepts for 350–m Water Depths," Ocean Industry, Apr. 1984, pp. 230–232.

"New Generation Semi For 5,000–FT Waters," Ocean Industry, Feb. 1985, pp. 77–78.

"Drilling Advances Stress Efficiency and Reliability," Tom Muhleman and Paul Dempsey, World Oil, Oct. 1983, pp. 55–61.

"Carousels Handle 10,000–ft Riser on Deepwater Semi," Ocean Industry, Aug. 1985, pp. 79–81.

"New Platform Uses Seabed Suction," Eric Ford, Offshore Engineering and Technology Handbook printed by Energy Publications, pp. 214–216.

"Concrete Semis for Storage and Production," Greger Kure, Offshore Engineering and Technology Handbook printed by Energy Publications, pp. 217–220.

"Deepwater Early Production Concept Speeds Payback," W. Y. Iwamoto, Ocean Industry, Jan. 1985, pp. 56–57.

"Semi–SPAR," Offshore Engineering: Development of Small Oilfields, pp. 168–169.

"Deepwater Production Riser," N.N.Panicker and I. R. Yancey, Journal of Petroleum Technology, Aug. 1984, pp. 1392–1400.

"Summer Ice Floe Impacts Against Caisson–Type Exploratory and Production Platforms," P. Croteau, M. Rojansky and B.C. Gerwick, Journal of Energy Resources Technology, Jun. 1984, vol. 106, pp. 169–175.

"Deepwater Drilling and Production Technology: An Overview," Ronald L. Geer, Marine Technology Society Journal, v. 16 n.2, pp. 8–15.

"Improving Offshore Structures Promote Arctic Development," John C. Bruce, Petroleum Engineer International, May 1983, pp. 44–54.

"Offshore Test Crowns Seven Year Subsea Development," Offshore Engineer, Sep. 1985, pp. 140–143.

"Technomare Attacks High Technology From the Deep End," Offshore Engineer, Mar. 1983, pp. 32–35.

"The Guidelineless Caisson Subsea Completion System," R. L. Wilkins, E. J. Cegielski, Underwater Technology, 1982, pp. 37–50.

Subsea Facilities, Caissons and Buoyant Apparatus, Offshore Drilling Technology by Carmichael, 1975, pp. 354–359.

The Development of Articulated Buoyant Column Systems as an Aid to Economic Offshore Production; John S. Smith, Reginal S. Taylor, European Offshore Petroleum Conference and Exhibition; pp. 545–550, Figures 1–14.

"Design Methodology for Offshore Platform Conductors," Bernhard Stahl and Michael P. Baur, Journal of Petroleum Technology, Nov. 1983, pp. 1973–1984.

"The Single Steel Drilling Caisson: A New Arctic Drilling Unit," A. Hippman and W. Kelly, Journal of Petroleum Technology, Dec. 1985, pp. 2219–2229.

"A Feasibility Study on the Use of Subsea Chokes in Well Control Operations on Floating Drilling Vessels," J. L. Mathews and A. T. Bourgoyne, Jr., Journal of Petroleum Technology, May 1982, pp. 1133–1139.

"Method of Dealing with the Stability of Semisubmersibles" by C. Kuo, D. Vassalos and B. S. Lee, Paper presented at the Symposium Semi–Submersibles: the New Generations, held on 17 and 18 Mar., 1983 [TC1665 S471 1983].

Stability and Capsizing os Semisumersibles, vols. 1 and 2, University of Strathclyde Maintenance Activities Subsea Surface, Proceedings of the Third International Offshore Mechanics and Arctic Engineering Symposium, Offshore Oil and Gas Pipeline Technology, Jan. 28 and 29, 1986 [TN871.3 S775 v.1 & v.2].

SPAR, 1993; Contact: Marketing Dept., Rauma–Repola Offshore Co., P. O. Box 206, SF–28101, Pori, Finland.

Nautical Education for Offshore Extractive Industries: Transportation 1977, pp. 37–43.

Review of Marine Equipment and Structures for Support of Drilling Operations Offshore Beaufort Sea, published in the Proceedings of the Third International Offshore Mechanics and Arctic Engineering Symposium, vol. 1, pp. 335–341.

Article re TM153 seabed test; Offshore Engineer, Aug. 1985, p. 43.

A Caisson Drilling & Completion System, Offshore Oil and Gas Pipeline Technology, Jan. 24/25, 1985.

* cited by examiner

FLOATING OFFSHORE STRUCTURE CONTAINING APERTURES

RELATED CASE

This is a continuation-in-part of application Ser. No. 09/146,790, filed on Sep. 3, 1998, now U.S. Pat. No. 5,983,822 issued Nov. 16, 1999.

BACKGROUND OF THE INVENTION

This invention relates to a floating offshore structure and more particularly to a floating platform used for the production and/or drilling of oil and gas.

Typically, in the oil industry, the offshore production and drilling for oil and gas has involved the use of a platform set on the ocean bottom and extending to a production or drilling platform above the water's surface. These types of operations are generally performed in water of less than 1300 feet. However, once drilling and/or production in deeper water began to be developed, the use of a solid structure stretching from the ocean surface to the bottom became impractical. Thus, alternative methods were developed for offshore drilling and production operations in deep water (over 1300 feet deep), and ultra deep water (over 2,000 feet deep).

Many different methods and devices have been proposed and used in deep water, most of which have involved some sort of floating platform. One such device is the tension leg platform, which is moored to the sea floor through the use of groups of vertically arranged high tension wires. Such arrangements, however, have not provided the control over the motion of the platform necessary for continuous, effective offshore operations. Specifically, the watch circle, defined as the circle of movement by the platform on the ocean's surface relative to the sea floor, may not be suitable for easily performing drilling and production operations. Additionally, the breakage of a high tension wire could have catastrophic effects on these operations, resulting in loss of life, platform, as well as threatening the environment.

Additional deep water offshore production and drilling apparatus include floating or semi-submersible platforms or vessels which are moored to the sea floor through the use of conventional catenary mooring lines. These types of platforms, however, while useful in deep water, can become problematic when used in ultra deep water because the vessel's watch circle can increase beyond acceptable levels when extremely lengthy catenary or other mooring lines are used. This is especially the case in high or rough seas, which can result in increased down time. Thus, such floating platforms are usually precluded from operating in ultra deep water.

One type of device that has been developed for use in deep and ultra deep water is the SPAR disclosed in U.S. Pat. No. 4,702,321 to Horton. Such prior art SPARs have had solid sides throughout their length and, thus, have allowed a substantial degree of movement both longitudinally and vertically, as well as in the pitch, roll, and yaw directions. This can cause an increased shutdown time for well production in times of bad weather or intense currents as well as safety concerns. Additionally, the risers which bring oil up from the bottom of the ocean travel through the center of the prior art SPAR with no outlet to the sea other than that at the SPAR's bottom. Thus, if a breakage or leak occurs in the risers while in the middle of the SPAR body, such leaks have no way to escape, and a dangerous situation can be created.

SUMMARY OF THE INVENTION

The disclosed floating offshore structure addresses and solves the problems that have been associated with prior art SPARs by disclosing a SPAR-type structure that has apertures throughout a portion of its body. The present invention comprises an offshore floating structure which has an outside surface that can be polygon or cylindrically shaped. The structure is comprised of sides that are welded or otherwise connected together to form a wall or outer shell. This floating structure is comprised of distinct portions, each having a centerwell wide enough to accommodate a typical riser system running longitudinally through its center. The top portion includes an operating platform located above the surface of the water, which can be used both for drilling and/or production of oil and gas. Below this operating platform are located buoyancy tanks which are sufficient to maintain the structure afloat such that the operating platform remains an acceptable level above the surface of the water. These buoyancy tanks can be placed around the wall of the structure, preferably internally, such that they define a centerwell, with enough space for a riser system to pass through the longitudinal center of the centerwell. A first portion of the offshore platform consists of only the outside wall, and contains a series of apertures in each side of the structure. These apertures allow underwater currents to freely pass laterally through the structure without buffeting its sides or causing vibration or unnecessary movement. These apertures also allow oil and gas to dissipate into the sea if a riser running up through the structure ruptures. These apertures can also comprise a coaming surrounding each aperture, which consists of a solid extension protruding laterally from the side of the structure, surrounding each aperture. These coamings reduce the movement of the structure by creating damping forces in response to the structure's attempt to move in the horizontal, vertical, roll, pitch, or yaw directions. Thus, the structure can remain much more stable than previous SPARs.

A second portion of the structure comprises a weighting section, such as a water or fluid retention tank and/or a fixed ballast. This portion lowers the center of gravity of the structure. The fluid retention tank can have two uses. It can be left empty while floating the offshore structure into place, and then filled to tip the structure into position. The tank then also provides additional weight to the structure, lowering its center of gravity. A ballast can then be added, as necessary, to the bottom of the structure in order to further lower the center of gravity of the structure to the required level. The structure, once in place, can then be moored to the sea floor by any conventional means, such as high tension mooring wires or conventional catenary mooring lines.

The primary object of the present invention is thus to provide a novel offshore floating structure for operations relating to the drilling and/or production of oil and gas.

Another object of the invention is to provide a SPAR-type floating offshore structure which is lighter weight, yet has reduced movement and high structural integrity, as compared to other types of floating platforms and SPARs.

Another object of the invention is to provide a SPAR-type floating platform which can disperse oil or gas spills resulting from a rupture in the riser system running through the center of the platform, thus resulting in higher safety and shorter shutdown time.

BRIEF DESCRIPTION OF THE DRAWINGS

FIG. 1(*b*) is a side cross-sectional view of the floating offshore structure.

DETAILED DESCRIPTION OF ILLUSTRATIVE EMBODIMENTS

Figure 1A:
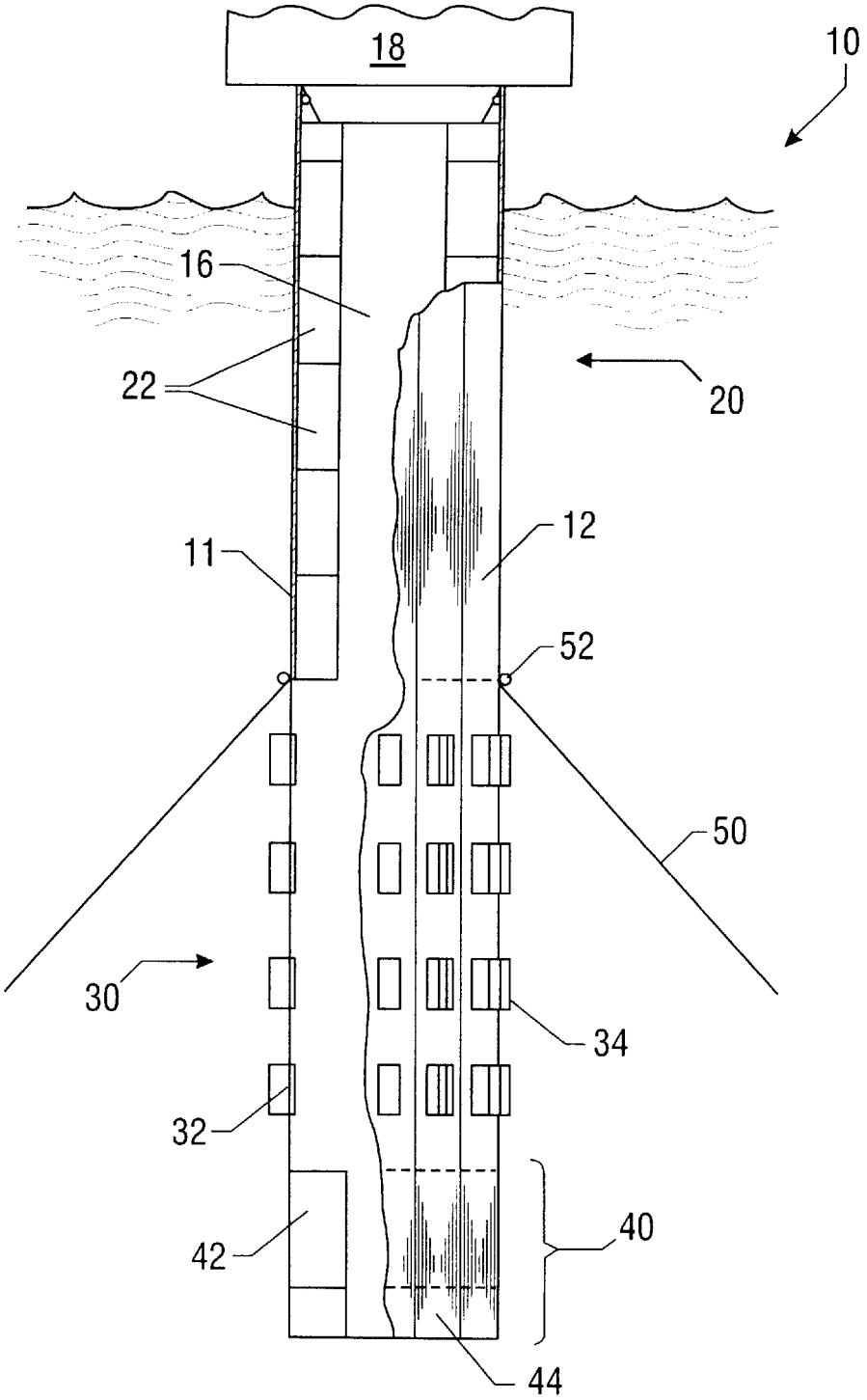
FIG. 1(*a*) is a side partial cutaway view of the floating offshore structure.
Figure 1B:
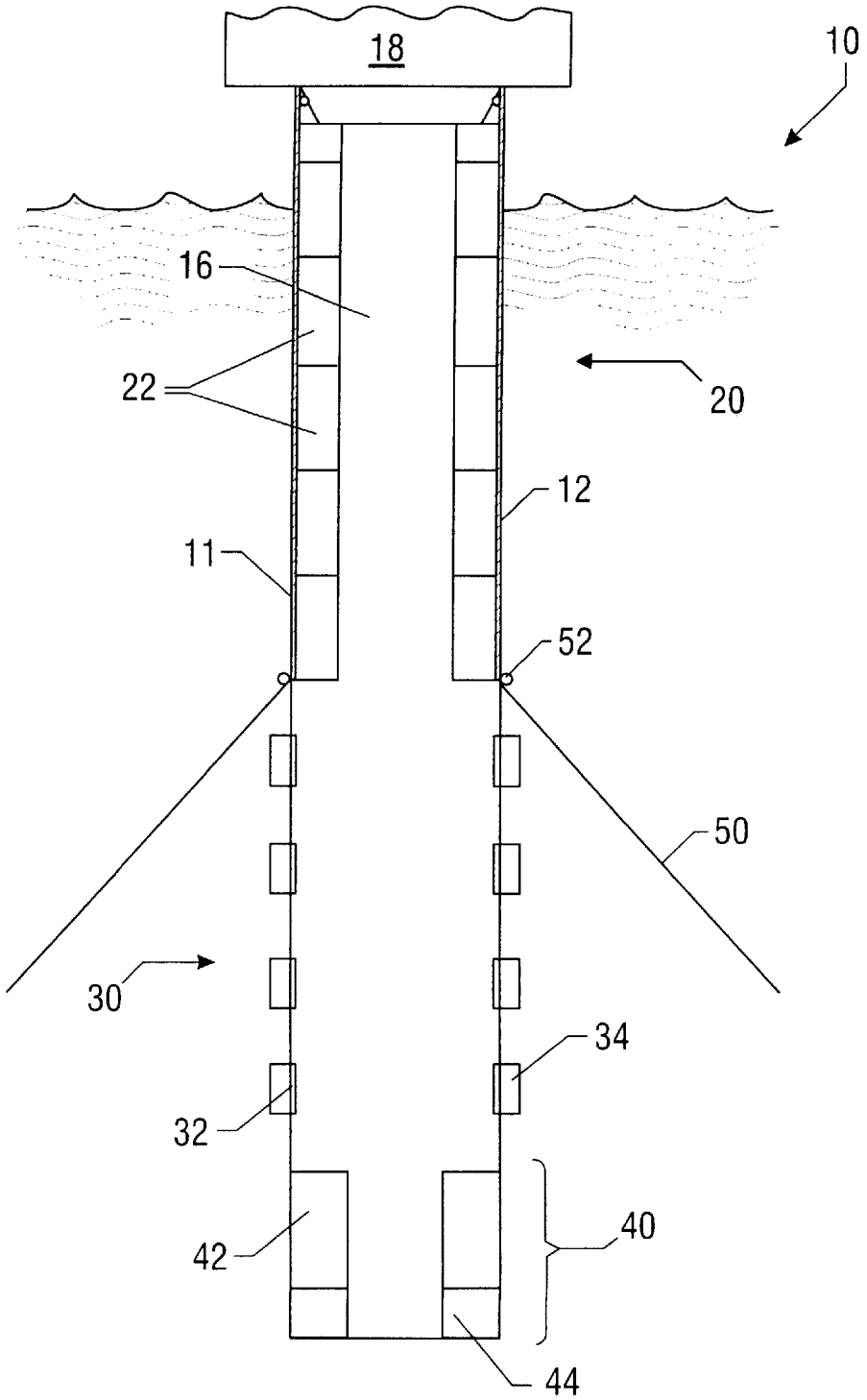

In FIGS. 1(*a*) and 1(*b*), a floating offshore structure is generally indicated at 10. The structure, as indicated, is made up of an outer shell 12, having both an inner and outer surface, forming a wall 11 and having a centerwell 16 sufficient to receive conventional risers through its center. As seen in the drawing, structure 10 has three distinct portions. These are a top portion 20, containing a means for keeping the structure buoyant, such as buoyancy tanks, a first portion 30, containing apertures, and a second portion 40, to lower the structure's center of gravity and keep it stable. Structure 10 can also have mooring lines 50 which keep the structure suitably connected to the sea floor. The structure can also contain an operating platform 18 rising out of the surface of the water, such that offshore drilling and/or production operations can be performed and production equipment can be stored without interference from the waves of the ocean's surface.

Figure 2:
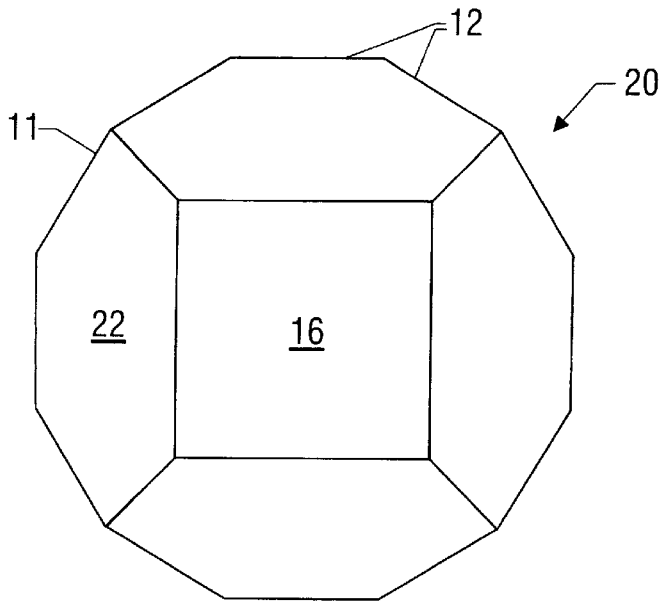
FIG. 2 is a top cross-sectional view of an embodiment of the top portion of this invention.

Top portion 20 of structure 10 consists primarily of operating platform 18 and buoyancy tanks 22. Operating platform 18 is preferably attachable to wall 11 of the structure. Buoyancy tanks 22, as shown in FIG. 1(*a*), are preferably located inside the shell 12 of the structure, and run along the structure's inner sides, such that a centerwell 16 is defined in the longitudinal center of the structure, as seen in FIG. 2. Buoyancy tanks 22 can be large air tanks sufficient to maintain the buoyancy of the structure such that the operating platform 18 remains above the water's surface a sufficient distance to maintain operations. This distance will usually be predetermined before manufacturing the structure. The width and length of buoyancy tanks 22 may be varied depending on the size and/or weight of the structure, and/or the necessity of having a wider or narrower centerwell 16. One of ordinary skill in the art should be able to ascertain the necessary increase in geometric size of the tanks per increase in weight, or their increase in structure length if a wider centerwell is desired. The total length of buoyancy tanks 22, however, is preferably approximately one-half of the total length of structure 10. The key to the size of buoyancy tanks 22, though, is to maintain the operating platform 18 a sufficiently operable distance above the ocean's surface. Thus, buoyancy tanks 22 can be more or less than one-half of the length of the structure, as long as the above goal is maintained.

As shown in FIG. 1(*b*), the first portion 30 of structure 10 consists of an outer shell 12, defining a wall 11 containing apertures 32. First portion 30 is preferably between one-third to one half of the total length of structure 10. Apertures 32 are present for two primary reasons. First, the apertures allow the movement of water currents laterally through the center of the structure, such that the structure is not buffeted by these currents, causing unnecessary movement. Additionally, apertures 32 allow any leakage caused from a rupture of the risers running through the center of the structure to dissipate into the ocean rather than to dangerously build up in centerwell 16.

Figure 4:
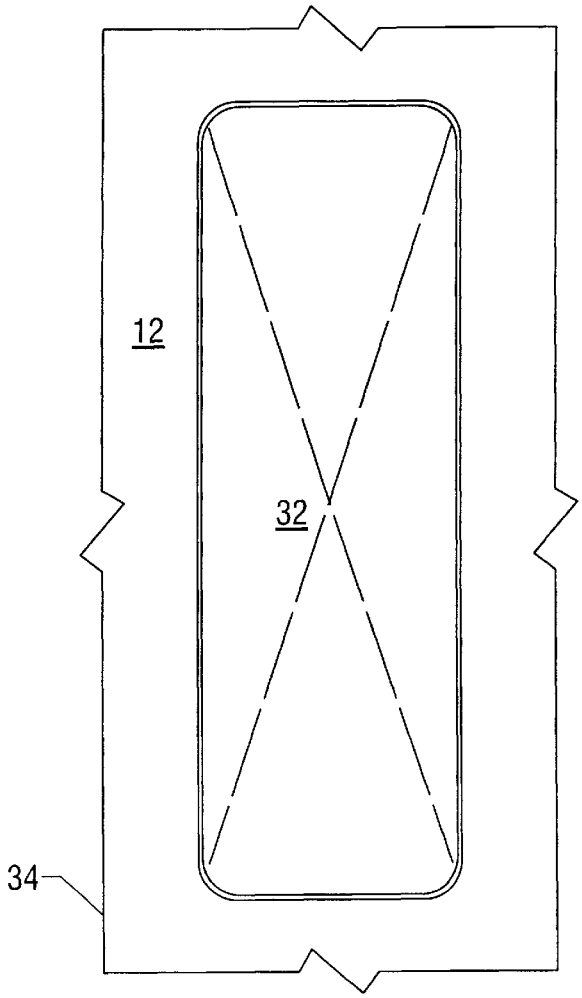
FIG. 4 is a front view of an embodiment of an aperture and coaming located on the wall of the floating offshore structure.

Apertures 32 are preferably located around wall 11 of the structure, and can be of any size or shape that reduces the amount of motion of the structure due to undersea currents. Preferably, however, these apertures are rectangular in shape, as shown in FIG. 4, and large enough so as to maximize the amount of water flowing laterally through the structure while reducing the structure's motion. For example, in a preferred embodiment of the invention, which is approximately 120 feet wide and 700 feet tall, having twelve apertures 32 per row surrounding the structure, apertures 32 will preferably be 30 feet tall by 10 feet wide, centered evenly in four rows around the outer shell. However, the arrangement of these apertures can be varied by one of ordinary skill in the art, so long as reduced motion is achieved. Additionally, the total area of first portion 30 of structure 10 should preferably not be more than one-third open. The area of first portion 30 comprises the area of wall 11 beginning below the bottom of buoyancy tanks 22 and ending immediately above fluid retention tank 42, or ballast 44, whichever is located higher up on structure 10. One of ordinary skill in the art should be able to develop an aperture arrangement and size to minimize the motion on the structure while staying within these parameters.

The width and height of apertures 32 can also be varied depending on the number of apertures desired. Obviously, if the width of the structure remains constant, but more apertures are used, each aperture will be thinner. Thus, apertures 32 may need to be made taller and thinner or reduced in size somewhat to maintain the structural integrity of structure 10. Preferably, apertures 32 should be shaped such that their length is approximately three times their width. However, such apertures can be of any effective size, as long as the structural integrity of structure 10 is maintained, and the movement of the structure caused by undersea currents is minimized.

Figure 3:
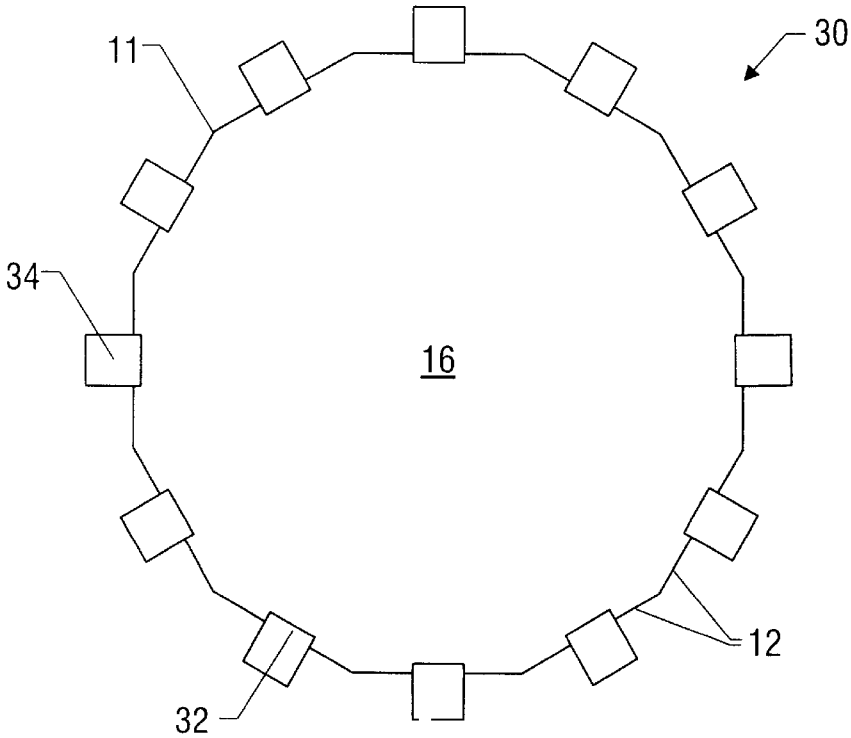
FIG. 3 is a top cross-sectional view of an embodiment of the first portion of this invention.
Figure 5:
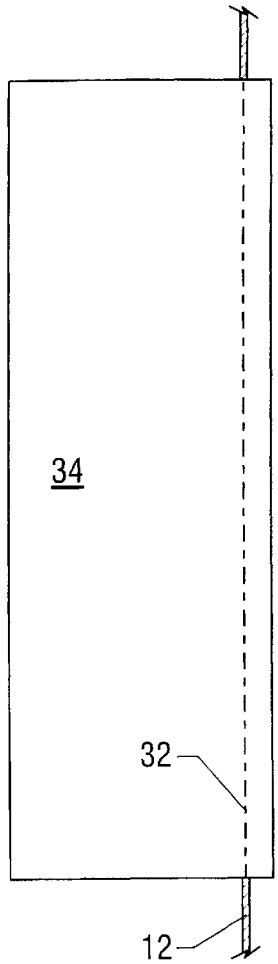
FIG. 5 is a side view of an embodiment of an aperture and coaming, showing the location of the coaming around the aperture.
Figure 6:
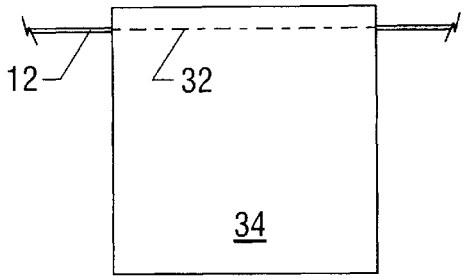
FIG. 6 is a top view of an embodiment of an aperture and coaming, showing the location of the coaming around the aperture.

First portion 30 of structure 10 may also contain a coaming 34 which dampens the undersea forces acting on the structure, resulting in less vertical, horizontal, roll, pitch, and yaw movement. Coaming 34 is shown in FIG. 3. Coaming 34 is made up of "baffles," of metal or any other suitable material, which preferably completely surround the area of each aperture and extend outwardly from wall 11 of structure 10, generally following the sides of apertures 32. Coaming 34 can be generally seen in FIGS. 5 and 6 as extending outwardly from the outer shell 12 of structure 10. In a preferred embodiment, each coaming 34 extends outwardly from wall 11 a distance approximately equal to the width of aperture 32 that it surrounds. The purpose of such coaming is to dampen the movement of structure 10 caused by undersea forces. Thus, coaming 34 can extend a longer or shorter distance from wall 11, depending on the amount of damping needed. Coaming 34 can also alternatively be located around only selected apertures 32 or at other points along wall 11 of structure 10, depending upon the amount of damping desired. Generally, however, the longer and more abundant the coaming on wall 11, the more damping effect will be received by structure 10, and the more stable the structure will be.

Second portion 40 of structure 10 serves primarily as a weight to lower the structure's center of gravity, and can be made up of two distinct parts, as seen in FIG. 1(*a*). Fluid retention tank 42 is preferably located directly below first portion 30 of the structure, and can be situated around the inside of outer shell 12 of structure 10 such that centerwell 16 is defined. Fluid retention tank 42 serves two purposes. First, when empty, it acts as a floatation device for the bottom of the structure as it is being towed out to its final location. When in place, fluid retention tank 42 can then be filled, tipping the structure into its correct position. Fluid retention tank 42, when filled, then acts to add weight to the bottom of the structure lowering its center of gravity, through its ability to retain variable volumes of fluids.

A ballast 44 can also be affixed to the bottom of structure 10. Ballast 44 is preferably a large block of metal or cement, or any other effective weight increasing material, that can be connected to the second portion of the structure, preferably underneath fluid retention tank 42. Ballast 44 primarily acts to add weight to the bottom of the structure, lowering the center of gravity of the structure as far as desired. It is preferable that the center of gravity of the structure be as low as possible, in order to maintain its stability, while still maintaining operating platform 18 an effective distance above the surface of the ocean. Additionally, ballast 44 should be placed around the bottom of structure 10 such that centerwell 16 is defined. Ballast 44 is also preferably added to structure 10 after the structure is in its offshore location and fluid retention tank 42 has been filled.

As a whole, second portion 40 of structure 10 is preferably between one-sixth and one-seventh of the total length of structure 10. However, depending on the size of fluid retention tank 42 used, as well as the required width of centerwell 16 running longitudinally through both ballast 44 and fluid retention tanks 42, this length can be changed as necessary. Additionally, a specific relative length and/or weight between fluid retention tank 42 and ballast 44 is not necessary, as long as a desirable center of gravity is achieved. One of ordinary skill in the art should be able to determine a relative weight of the two structures such that the center of gravity can be effectively lowered to a desirable level.

Outside shell 12 is preferably welded or riveted together, or connected using any ordinary ship building or large-scale fabrication techniques, to form wall 11, and the structure can be manufactured by using large sheets of metal or other suitable materials. Materials such as iron or steel are preferable, however, if a high corrosion rate is expected, corrosion-resistant steel or other such materials can be used.

The total length and width of structure 10 has no specific limitations. Preferably, the width of structure 10 should be approximately one-sixth of its length, but these dimensions can vary for many reasons, such as the depth of the water, wave period, or anticipated production rate. Additionally, centerwell 16 should be of a size that can accommodate a conventional riser system used to pump oil and gas from the sea bottom through the center of structure 10 to operating platform 18, and can have a polygon, cylindrical, or other effective shape. It is preferable that the width of centerwell 16 be approximately one-third of the width of structure 10. However, this width can be varied depending on the amount and size of the risers being utilized. Additionally, an increase or decrease in the width of centerwell 16 may result in a proportional increase or decrease in the length of each individual section of the structure, as both buoyancy and fluid retention tanks will increase in width as the centerwell decreases in width. This will correspondingly shorten the length of the top and second portions 20 and 40, while increasing the length of first portion 30.

Structure 10 can be used in any deep water operation. It is preferable, however, that structure 10 be used in water deeper than 2,000 feet. There is no known upper limit to the depth of the water in which the structure can be utilized.

Structure 10 should also be moored in some way to the sea floor, in order to keep it in a relatively stationary position relative to the sea floor. Any conventional means of mooring floating offshore structures can be used, including conventional catenary mooring lines, high tension mooring lines, or other releasable mooring means. These and other types of mooring techniques should be well known to one of ordinary skill in the art. Mooring lines 50 and connections 52, as seen in FIG. 1(*b*), are preferably located approximately one-third to half of the way down the length of the structure. However, any location and number of connections and lines that would sufficiently keep the structure in place relative to the ocean floor and maintain an effective watch circle can be utilized.

A preferred embodiment of structure 10 has a length approximately six times longer than its width, and has three distinct portions. A top portion 20 is located partially out of the water and comprises approximately half of the length of structure 10. At the top end of top portion 20, which protrudes above the water's surface, is located an operating platform 18 which should be a sufficient length above the water's surface to allow continuous production and/or drilling operations. The distance between the ocean's surface and operating platform 18 can generally be between approximately 25 to 100 feet. The top portion 20 of structure 10 also contains buoyancy tanks running around and being connected to the inside of wall 11 of structure 10 such that a centerwell 16 is defined in a central portion of the structure. In the preferred embodiment, the buoyancy tanks have a total width of approximately two-thirds the width of the structure, with the width of the centerwell comprising the remaining one-third width. Buoyancy tanks 22 should run to approximately half way down the length of the structure so as to provide enough buoyancy to the structure that operating platform 18 is maintained a suitable distance above the water.

Below top portion 20 of structure 10, is located first portion 30 which is primarily made up of outer shell 12 of structure 10. In this portion, outer shell 12 of structure 10 contains a plurality of apertures 32 which allow water currents to flow laterally through the center of structure 10. First portion 30 should also comprise approximately one-third to one-half of the structure's total length. Generally, enough apertures should be put around first portion 30 such that the area of the apertures is less than one-third of the total area of first portion 30, with a preferred area ratio being approximately 15 percent open. The preferred embodiment additionally has four rows of apertures and 12 columns of apertures in first portion 30.

Each aperture 32 is also preferably surrounded by a coaming 34, which is preferably comprised of metal baffles extending from outer shell 12. Each coaming 34 preferably completely surrounds each aperture 32. Each coaming 34 should also extend outwardly from outer shell 12 a distance equal to the width of the aperture that it surrounds.

Second portion 40 of structure 10 is preferably comprised of a fluid retention tank 42 which, like buoyancy tanks 22, extends around the inner sides of the structure 10 and forms a centerwell 16. Fluid retention tank 42 is preferably filled with water when structure 10 is in its final position, so as to lower the center of gravity of the structure. Directly below the fluid retention tank 42 is preferably placed a ballast 44 in order to add more weight to the bottom of the structure and lower its center of gravity to a desired level. Ballast 44 may be made up of any type of heavy material, such as iron, steel, or cement.

The preferred embodiment of structure 10 is also able to be releasably moored to the ocean floor, preferably with a plurality of catenary moorings 50. These moorings are preferably connected to structure 10 at a location approximately one-third to one-half of the way down from the top of the structure.

The current offshore floating structure has several advantages over prior floating structures, in that the apertures and coamings located in the first portion of the structure serve to reduce movement of the structure as a result of undersea currents. This, therefore reduces down time as a result of bad weather or other ocean occurrences. This translates into increased productivity and profitability of the structure. The apertures also serve to dissipate any dangerous oil and gas leakage that can occur in the centerwell of the structure, and serves to lighten the structure while maintaining its structural integrity.

What is claimed is:

1. An offshore floating structure comprising:

an outer wall, said wall defining a centerwell through the longitudinal central portion of said structure;

an operating platform, said platform being attachable to said wall;

buoyancy tanks connected to the inner sides of said structure, said buoyancy tanks being sufficient to maintain the operating platform a predetermined distance above the surface of a body of water after said operating platform has been attached to said wall;

a first portion of said wall having a plurality of apertures, the total surface area of said apertures being less than or equal to the one third of the total surface area of said first portion of said wall, said first portion of said wall further including a coaming surrounding one or more of said apertures, each of said coamings protruding outwardly from said wall;

a second portion of said wall including a fluid retention tank connected to the inner sides of said wall, said tanks being characterized by the ability to retain variable volumes of fluid;

a ballast located beneath said fluid retention tank; and a means for releasably mooring said structure.

2. An offshore floating structure comprising:

an outer wall, said wall defining a centerwell through the longitudinal central portion of said structure;

buoyancy tanks connected to said wall, said buoyancy tanks sufficient to maintain the buoyancy of said structure such that a portion of said wall is maintained a predetermined distance above the surface of a body of water;

a plurality of apertures in the sides of a first portion of said wall, the first portion of said wall containing no solid inner wall;

a means for lowering the center of gravity of said structure; and a means of mooring said structure to the floor of a body of water.

3. The offshore floating structure of claim 2, further comprising an operating platform being attachable to said structure, and able to be maintained a predetermined distance above the surface of a body of water.

4. The offshore floating structure of claim 2, said buoyancy tanks being located inside of said outer wall.

5. The offshore floating structure of claim 2, further comprising a coaming surrounding one or more of said apertures.

6. The offshore floating structure of claim 1 or 5, each said coaming completely surrounding the area of each said aperture.

7. The offshore floating structure of claim 2, said means for lowering the center of gravity of said structure comprising a fluid retention tank.

8. The offshore floating structure of claim 7, said fluid retention tank being connected to the inside of said outer wall, and defining a centerwell running longitudinally through a central portion of said fluid retention tank.

9. The offshore floating structure of claim 2, said means for lowering the center of gravity of said structure comprising a ballast located at the bottom of said structure.

10. The offshore floating structure of claim 2, said means for lowering the center of gravity of said structure comprising a fluid retention tank and a ballast, both of said fluid retention tank and ballast defining a centerwell through a longitudinally central portion of said fluid retention tank and ballast.

11. The offshore floating structure of claim 2, said means of mooring said structure to the floor of a body of water comprising a catenary mooring system.

12. The offshore floating structure of claim 2, said means of mooring said structure to the floor of a body of water comprising a plurality of high tension mooring wires.

13. An offshore floating structure comprising:

an outer wall, said wall defining a centerwell through the longitudinal central portion of said structure;

buoyancy tanks connected to said wall, said buoyancy tanks sufficient to maintain the buoyancy of said structure such that a portion of said wall is maintained a predetermined distance above the surface of a body of water;

a plurality of apertures in the sides of a first portion of said wall, with a coaming completely surrounding one or more of said apertures;

a means for lowering the center of gravity of said structure; and a means of mooring said structure to the floor of a body of water.

* * * * *